US009154878B2

(12) United States Patent
Lee et al.

(10) Patent No.: US 9,154,878 B2
(45) Date of Patent: Oct. 6, 2015

(54) INTERCONNECTED SPEAKER SYSTEM

(71) Applicant: Monster, LLC, Las Vegas, NV (US)

(72) Inventors: Noel Lee, Las Vegas, NV (US); Demian Martin, San Leandro, CA (US); Anthony Di Chiro, Chatsworth, CA (US)

(73) Assignee: Monster, LLC, Las Vegas, NV (US)

( * ) Notice: Subject to any disclaimer, the term of this patent is extended or adjusted under 35 U.S.C. 154(b) by 217 days.

(21) Appl. No.: 13/737,753

(22) Filed: Jan. 9, 2013

(65) Prior Publication Data

US 2013/0177159 A1 Jul. 11, 2013

Related U.S. Application Data

(60) Provisional application No. 61/585,205, filed on Jan. 10, 2012.

(51) Int. Cl.

| | |
|---|---|
| ***H04R 5/00*** | (2006.01) |
| ***H04R 5/04*** | (2006.01) |
| *H04S 1/00* | (2006.01) |
| *H04S 3/00* | (2006.01) |

(52) U.S. Cl.
CPC ..... *H04R 5/04* (2013.01); *H04R 2420/07* (2013.01); *H04S 1/00* (2013.01); *H04S 3/00* (2013.01)

(58) Field of Classification Search
None
See application file for complete search history.

(56) References Cited

U.S. PATENT DOCUMENTS

| | | | | |
|---|---|---|---|---|
| 6,219,426 | B1 * | 4/2001 | Daniels et al. | 381/307 |
| 2008/0255857 | A1 * | 10/2008 | Pang et al. | 704/500 |
| 2008/0273712 | A1 * | 11/2008 | Eichfeld et al. | 381/86 |
| 2008/0273722 | A1 * | 11/2008 | Aylward et al. | 381/302 |
| 2010/0316237 | A1 * | 12/2010 | Elberbaum | 381/300 |
| 2012/0121092 | A1 * | 5/2012 | Starobin | 381/17 |
| 2013/0080794 | A1 | 3/2013 | Hsieh | |

OTHER PUBLICATIONS

U.S. Appl. No. 13/640,299; Jan. 3, 2011; Lee, Noel.

* cited by examiner

*Primary Examiner* — Tan X Dinh
(74) *Attorney, Agent, or Firm* — John Nielsen; Sentinel IP

(57) ABSTRACT

A system that alters the frequency and/or phase response to attenuate the signal to a first internal channel within a speaker box having two speakers so as to minimize interference with the second speaker when reproducing a mono signal (either left or right) in an interconnected stereo system.

7 Claims, 1 Drawing Sheet

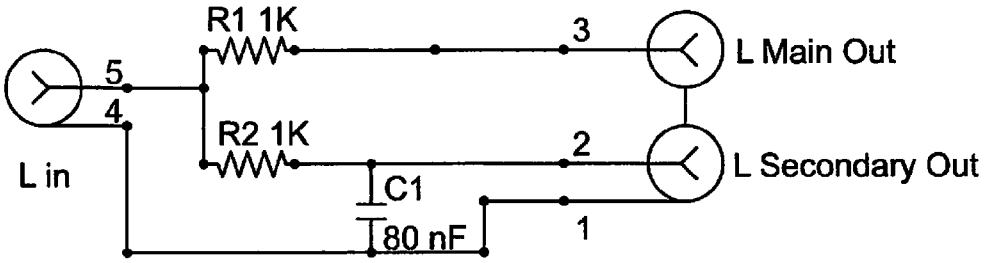
R1 1K
3
L Main Out
5
4
R2 1K
2
L Secondary Out
L in
C1
80 nF
1
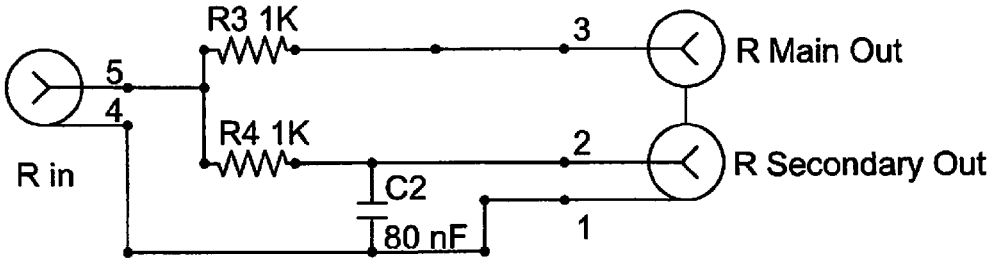
R3 1K
3
R Main Out
5
4
R4 1K
2
R Secondary Out
R in
C2
80 nF
1

INTERCONNECTED SPEAKER SYSTEM

CROSS REFERENCE TO RELATED APPLICATIONS

The present application claims the priority of U.S. Provisional Patent Application Ser. No. 61/585,205, entitled "Inter-Connected Speaker System", filed Jan. 10, 2012, which application is incorporated in its entirety herein by reference.

BACKGROUND

Listening to audio in stereo started to become popular in the 1930s. It has been used in dedicated applications like movie theaters since the 1950's and became fairly common for home listening in the late 1960's. As stereo became expected in many audio applications, most self-contained audio devices have stereo speakers attached.

Generally, a broader stereo image is created when speakers have a significant separation from each other. In contrast, close proximity of stereo speakers limits the spread of the generated stereo image. While sound generated by closely positioned speakers can be satisfying, in a domestic listening situation the potential of the stereo aural image is constrained. One limitation comes from having both channels in the single box. The user of such a 'single speaker box' system is limited to a few options. First, the user can connect the left channel from the source to the left speaker, and connect the right channel from the source to the right speaker. This option will sacrifice the maximum output and dynamics.

Alternatively, a user can connect both channels from the source to each speaker tied to the appropriate channel, but the close proximity of the higher frequency radiators can cause interference and very ragged frequency response at higher frequencies, reducing the benefit of using both speakers. These problems may cause a user to discard their system for separate boxes for each channel and leaving the original system unused.

As such there arises a need for a system that incorporates the user's existing speaker box info a system that effectively separates the left and right channels of a stereo system.

BRIEF SUMMARY OF THE INVENTION

This system/method involves using two self-contained stereo speakers to create a larger scale stereo system and avoid the compromises above. The basic principle is to alter the frequency and phase response of one of the two channels in the system so it will not interfere with the other when reproducing a mono signal (either left or right in this example but could be many channels in a multi-channel surround or distributed audio system).

BRIEF DESCRIPTION OF THE DRAWING

FIG. 1 depicts a schematic of some of the electrical components in an embodiment of the invention.

DETAILED DESCRIPTION OF THE INVENTION

Working with a system with two speaker boxes (as shown in FIG. 1), where each speaker box has a left channel speaker/driver and a right channel speaker/driver), the simplest option is to roll off (e.g. to reduce response at the upper or lower ends of the working frequency range) one of the two channels of approximately 6 dB per octave above the frequency where the distance between the drivers of the two speakers is a significant part of a wavelength at that frequency. For instance, at approximately 5.5 kHz, the wavelength of the sound would be approximately 6 cm. At 20 kHz, the wavelength is approximately 1.65 cm.

A shelving filter can be used to apply an equal gain change to all frequencies beyond a user-selected shelving frequency, rather than applying a progressive gain change beyond a cutoff point. Such filters require not only a control for selecting the shelving frequency, but also one for selecting the amount of cut or boost applied.

A further option is to delay one of the two drivers such that they are in phase at the desired focus in the room. A combination of these can be used to optimize the effect. They all get the full benefit of the extra driver and power output below any cut-off frequency and some benefit is realized from the high frequency (HF) driver even when its amplitude is reduced (attenuated).

The invention can be implemented in a wireless system with Bluetooth technology that allows a stereo signal to be sent to one speaker and then passed to a second with a second Bluetooth link. However the technologies do not address the stereo interference problems in a self-contained stereo speaker that are expecting mono speakers at each destination. The technique described herein can be applied to these systems and engaged when the specific mode is enabled either with a manual switch on each system or some form of automation via communications between the devices.

An analog implementation is shown in FIG. 1. The left channel signal would be routed to the left speaker by either a special cable, an adapter box or if using digital transport systems (wired or wireless) software that routes the left signal to the left channel speaker.

At the left channel speaker, for example, the signal is split into a first and a second internal channel. The first internal channel is routed without modification to the first driver (number 3 in this case) as the "L main out". The second internal channel is modified, and then sent to the second driver (L secondary out). The modification can be accomplished with an analog low pass filter with, for example, a −3 dB roll off at a frequency such that the distance in acoustic wavelength between the first and second drivers is less that ½ of a full wave so that as the wave lengths get shorter, the signal level from the alternative speaker is reduced enough that it will have less than a 3 dB influence on the acoustic pressure at the listeners position.

High-pass & Low-pass Filters can be used to attenuate the secondary signals. A high-pass filter (sometimes called a low-cut filter) progressively reduces the level of any audio frequencies below a user-specified 'cutoff' frequency, while leaving the level of those above this point comparatively unchanged. On the other hand, the low-pass filter (sometimes called a high-cut filter) reduces the level of frequencies above the cutoff point, leaving those below comparatively unchanged.

It is also possible to use a shelving network that will roll off as above but flattened out (shelve) and an attenuated level (possibly −6 dB) that will allow the energy from the sending channel to contribute without degrading the primary channel. This can be done with an RCR network such that there is a series R and a shunt C causing the primary roll off and a series resistors that limit the roll off from the shunt C.

Finally, it is possible to use an all pass network (phase shift network) to delay one of the channels in the speaker so that at the listening location, its time of arrival matches the other channel. This will cause interference at other locations in the room reducing signals. This can be used to control the dispersion of the speaker to focus it at the desired location. The easiest way to do this is to delay with a digital signal storing the signal in memory for the necessary time to delay and then passing to the conversion circuit and the speaker. It can also be done with an all pass network that changes the phase with frequency without changing the amplitude.

An all-pass filter is a signal processing filter that passes all frequencies equally, but changes the phase relationship between various frequencies. It does this by varying its propagation delay with frequency. Generally, the filter is described by the frequency at which the phase shift crosses 90 degree (i.e., when the input and output signals go into quadrature—when there is a quarter wavelength of delay between them).

They are generally used to compensate for other undesired phase shifts that may arise in the system, or for mixing with an un-shifted version of the original to implement a notch comb filter. They may also be used to convert a mixed phase filter into a minimum phase filter with an equivalent magnitude response or an unstable filter into a stable filter with an equivalent magnitude response.

An implementation uses a high-pass filter at the non-inverting input to generate the phase shift and negative feedback to compensate for tire filter's attenuation. At high frequencies, the capacitor is a short circuit, thereby creating a unity-gain voltage buffer (i.e., no phase shift). At low frequencies and DC, the capacitor is an open circuit and the circuit is an inverting amplifier (i.e., 180 degree phase shift) with unity gain. At the corner frequency $\omega=1/RC$ of the high-pass filter (i.e., when input frequency is $1/(2\pi RC)$), the circuit introduces a 90 degree shift (i.e., output is in quadrature with input; it is delayed by a quarter wavelength).

Regarding the implementation using low-pass filters, a similar all-pass filter can be implemented by interchanging the position of the resistor and capacitor, which turns the high-pass filter into a low-pass filter. The result is a phase shifter with the same quadrature frequency but a 180 degree shift at high frequencies and no shift at low frequencies. In other words, the transfer function is negated, and so it has the same pole at $-1/RC$ and reflected zero at $1/RC$. Again, the phase shift of the all-pass filter is double the phase shift of the first-order filter at its non-inverting input.

Attention can also be achieved through voltage control. The resistor can be replaced with a FET in its ohmic mode to implement a voltage-controlled phase shifter; the voltage on the gate adjusts the phase shift. In electronic music, a phaser typically comprises four or six of these phase-shifting sections connected in tandem and summed with the original. A low-frequency oscillator (LFO) ramps the control voltage to produce the characteristic swooshing sound.

These circuits are used as phase shifters and in systems of phase shaping and time delay. Filters such as the above can be cascaded with unstable or mixed-phase filters to create a stable or minimum-phase filter without changing the magnitude response of the system. For example, by proper choice of pole (and therefore zero), a pole of an unstable system that is in the right-hand plane can be canceled and reflected on the left-hand plane.

The benefit to implementing all-pass filters with active components like operational amplifiers is that they do not require inductors, which are bulky and costly in integrated circuit designs. In other applications where inductors are readily available, all-pass filters can be implemented entirely without active components. There are a number of circuit topologies that can be used for this.

What is claimed is:

1. A stereo system comprising an audio source that sends audio signals, the signals having a frequency range, to a plurality of audio speakers, the system comprising:

a. A plurality of audio speakers, comprising at least a left speaker and a right speaker, and wherein each speaker comprises:
   i. a first driver;
   ii. a second driver;

b. an audio signal processing means that:
   i. separates the audio signals from the audio source into at least a left channel and a right channel;
   ii. separates the left channel signal into:
      1. a left main signal comprising an unattenuated signal; and
      2. a left secondary signal, wherein the left secondary signal is attenuated at an upper and/or lower end of the frequency range to reduce interference between the first and second drivers;
   iii. wherein the left main signal is connected to the first driver of the left speaker;
   iv. wherein the left, secondary signal is connected to the second driver of the left speaker;
   v. separates the right channel signal into:
      1. a right main signal comprising an unattenuated signal; and
      2. a right secondary signal, wherein the right secondary signal is attenuated at an upper and/or lower end of the frequency range to reduce interference between the first and second drivers;
   vi. wherein the right main signal is connected to the first driver of the right speaker;
   vii. wherein the right secondary signal is connected to the second driver of the right speaker
   viii. wherein the audio signal processing means comprise a low-pass filter to attenuate the left and right secondary signals; and
   ix. wherein the low pass filter creates a −3 dB roll off at a frequency such that a distance in acoustic wavelength between the first and second drivers is less that ½ of a full wavelength of the signal frequency to attenuate the left and right secondary signals.

2. The stereo system of claim 1, wherein the audio signal processing means comprises a low-pass filter to attenuate the left and right secondary signals.

3. The stereo system of claim 1, wherein the audio signal processing means comprises an analog low pass filter to attenuate the left and right secondary signals.

4. The stereo system of claim 1, wherein the audio signal processing means comprises a filter capacitor to attenuate the left and right secondary signals.

5. The stereo system of claim 1, wherein the audio signal processing means comprises a high-pass filter to attenuate the left and right secondary signals.

6. The stereo system of claim 1, wherein the audio signal processing means comprises a shelving filter to apply an equal gain change to all frequencies beyond a shelving frequency to attenuate the left and right secondary signals.

7. The stereo system of claim 1, wherein the audio signal processing means comprises an all-pass filter that passes all frequencies equally, but changes phase relationships between frequencies to attenuate the left and right secondary signals.

* * * * *